US005098652A

United States Patent [19]

Yasui et al.

[11] Patent Number: 5,098,652

[45] Date of Patent: Mar. 24, 1992

[54] PRECISION PARTS OF NON-MAGNETIC STAINLESS STEELS

[75] Inventors: Tsuyoshi Yasui; Nobuaki Nakashima; Shinzo Sugai; Eiichi Watanabe, all of Yokohama, Japan

[73] Assignee: Kabushiki Kaisha Toshiba, Kawasaki, Japan

[21] Appl. No.: 536,311

[22] Filed: Jun. 11, 1990

[30] Foreign Application Priority Data

Jun. 13, 1989 [JP] Japan ..... 1-148433

[51] Int. Cl.[5] ..... C22C 38/00

[52] U.S. Cl. ..... 420/45; 148/135; 148/136; 420/56

[58] Field of Search ..... 420/45, 56; 148/135, 148/136

[56] References Cited

U.S. PATENT DOCUMENTS

| | | | |
|---|---|---|---|
| 4,141,762 | 2/1979 | Yamaguchi et al. | 420/45 |
| 4,302,247 | 11/1981 | Abe et al. | 420/46 |
| 4,371,394 | 2/1983 | Henthorne et al. | 420/46 |
| 4,818,484 | 4/1989 | DeBold et al. | 420/45 |

OTHER PUBLICATIONS

Schumann, Archiv. Eisenhuttenwesen 41 (1970) 1169.

"On the Plasticity Induced by Martensitic Transformation in Fe-Ni Alloys and Fe-Cr-Ni Alloys", Tamura et al., Journal of the Japan Institute of Metals, vol. 33 (1969), 1983.

"Influence of Chemical Composition on Martensitic Transformation in Fe-CR-Ni Stainless Steel", Hirayama et al., Journal of the Japan Institute of Metals, vol. 34 (1970), 507.

"Influence of Martensitic Transformation and Chemical Composition on Mechanical Properties of Fe-Cr-Ni Stainless Steel", Hirayama et al., Journal of the Japan Institute of Metals, vol. 34 (1970), 511.

"Influence of Structure and Chemical Composition on Fatigue Strength of Cold Rolled Fe-Cr-Ni Stainless Steel", Hirayama et al., Journal of the Japan Institute of Metals, vol. 34 (1970), 892.

"Influence of Cold Reduction on Martenstic Transformation in Fe-Cr-Ni Stainless Steel": Hirayama et al., Journal of the Japan Institute of Metals, vol. 35 (1971), 447.

*Primary Examiner*—Upendra Roy

*Attorney, Agent, or Firm*—Oblon, Spivak, McClelland, Maier & Neustadt

[57] ABSTRACT

The present invention provides non-magnetic stainless steel which is used as materials for small parts in precision machines and electronic equipment. The non-magnetic stainless steel consists of an iron-based alloy containing 9 to 22% by weight of nickel, 12 to 26% by weight of chromiun, the balance of iron and inevitable impurities. The martensitic area ratio of the iron-based alloy structure is not more than 20%. The stainless steel exhibits excellent workability and is suitable as a raw material for TV electron gun parts and small gears which are formed by strong working such as blanking or the like.

9 Claims, 1 Drawing Sheet

PRECISION PARTS OF NON-MAGNETIC STAINLESS STEELS

BACKGROUND OF THE INVENTION

The present invention relates to non-magnetic stainless steel having excellent workability, and particularly to non-magnetic stainless steel which permits an increase in the life of a mold used in machine working and an improvement in the quality of the precision parts produced by working.

Many small precision parts such as non-magnetic gears and the like are mounted in domestic electrical equipment such as television and video tape recorder (VTR), computers, magnetic recording devices, electronic equipment and the like. For example, small oval-shaped beam guide parts, each of which has a length of 15 mm, a width of 5 mm and a thickness of 2 mm and which are laminated in multiple stages, are mounted in an electron gun used for color television cathode ray tubes (CRT).

Such electron guns are generally used for attracting or repulsing the thermions emitted from the cathode of an electrode heated by a heater, converging them to a narrow beam or diffusing them to a wide beam when the thermions are passed through beam guide parts so as to apply them to a predetermined fluorescent surface of a cathode ray tube and to emit light. Each of color television cathode ray tubes is equipped with three electron guns for the primary colors, i.e., red, blue and green, and three through holes are formed in parallel in each of the beam guide parts in the axial direction thereof. Each of the beam guide parts is made of a non-magnetic material for the purpose of preventing any disturbance of an electron beam from being produced by magnetization with the passage of time.

Conventional beam guide parts are formed by, for example, blanking out them from a plate of 18-8 stainless steel which consists of an alloy containing 8.0 to 8.3 wt % of Ni, 18 to 19 wt % of Cr, 0.05 to 0.08 wt % of C, 0.8 to 1.0 wt % of Si and 1.0 to 1.4 wt % of Mn and then forming the three through holes by punching the plate.

When small beam guide parts used for television sets are produced by blanking out from 18-8 stainless steel, which is a general material, however, since the mold or the pressing part of a pressing system is easily damaged or broken off, the part products are damaged or broken. There is thus a problem in that the quality of the products is deteriorated, and the yield of the products is significantly decreased.

In the conventional blanking process, the operator must conduct a troublesome work of constantly checking the occurrence of defective products. In a stage where defective products easily occur, the operation is stopped, and the mold is polished again.

There are thus disadvantages in that, since the substantial life of the mold is short, the operation cannot be continued for a long period, and the production efficiency is low, and in that the maintenance, control and checking works require a great deal of labor.

In particular, when beam guide parts for television sets are produced by using conventional materials, the materials have poor blanking quality and a tendency to be greatly deformed. It is therefore necessary for preventing the deformation to increase the distance between the through holes formed in each part body.

Since the diameter of each of the through holes is thus relatively decreased, it is difficult to focus the electron rays passing through the through holes and increase the luminance of a cathode ray tube.

SUMMARY OF THE INVENTION

The present invention has been achieved for solving the above problems, and it is an object of the present invention to provide non-magnetic stainless steel which facilitates maintenance and control during working and which causes a significant increase in the life of the mold used and the formation of products showing a narrow scatter in quality.

It is another object of the present invention to provide a television set beam guide part which can be easily produced by using the above non-magnetic stainless steel with good blanking quality and which permits a significant increase in luminance of a television set.

The non-magnetic stainless steel of the present invention consists of an iron-based alloy containing 10 to 22% by weight of nickel, 12 to 26% by weight of chromium, the balance of iron and inevitable impurities, the ratio of the martensite area in the iron-based alloy texture being 20% or less.

The television set beam guide part of the present invention is made of the above non-magnetic stainless steel. The terms "non-magnetic stainless steel" referred to herein means stainless steel having permeability of 1.1 or less, more preferably 1.05 or less.

DESCRIPTION OF THE PREFERRED EMBODIMENTS

To achieve the above objects, the inventors first investigated the cause of the occurrence of defective products when precision parts are produced by strong working such as blanking, bending, drawing or the like using as a raw material conventional non-stainless steel.

Figure 1:
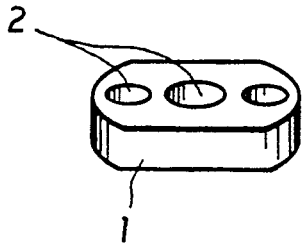
FIG. 1 is a perspective view of an example of the shape of a precision part.
Figure 2:
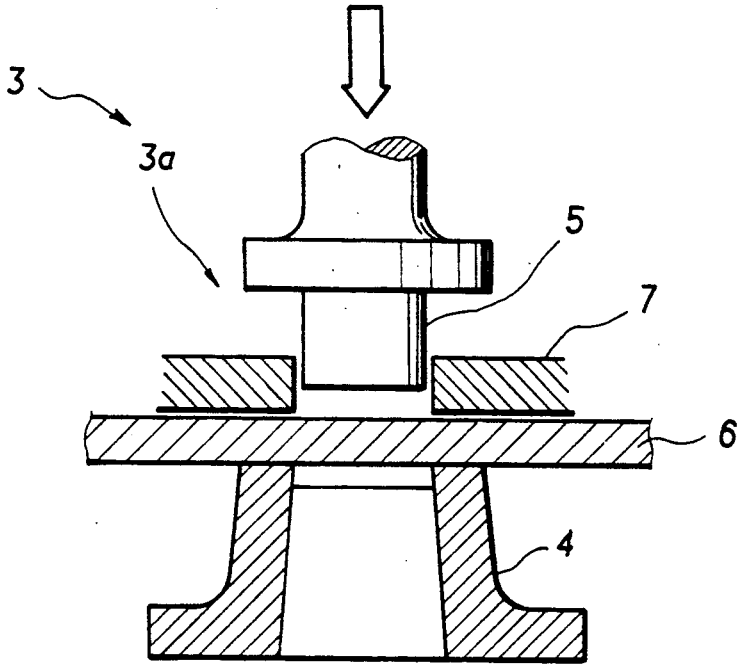
FIG. 2 is a sectional view of an embodiment of a pressing apparatus for blanking out a precision part.

The inventors continuously observed the operational state of the pressing system 3 shown in FIG. 2 when a beam guide part 1 having three through holes 2, as shown in FIG. 1, are formed by blanking in the use of the pressing system 3.

The pressing system 3 for producing beam guide parts is constructed by a set of three pressing machines 3*a* comprises, as shown in FIG. 2, a die 4 serving as a mold, a punch 5 having a sharp cutting edge, which is formed in the periphery at the end thereof, and a stopper plate 7 for holding a material 6 to be worked for which is placed on the die 4. The beam guide part 1 is manufactured in accordance with three working steps. In each of the steps, the part is cut out from the material 6 to be worked for when the material 6 is subjected to the shearing force of the punch 5 while being fixed on the die 4.

That is, first, the through holes 2 are made by blanking the material 6 by utilizing a first pressing machine 3*a*. Second, the through holes 2 are blanked again by using a second pressing machine 3*a* so that inner surfaces of the through holes 2 are shaved so as to have predetermined inside diameter. Thirdly, the material 6 is blanked at a peripheral edge portion enclosing the through holes 2 by using a third pressing machine 3a to form a beam guide part 1.

Figure 3:
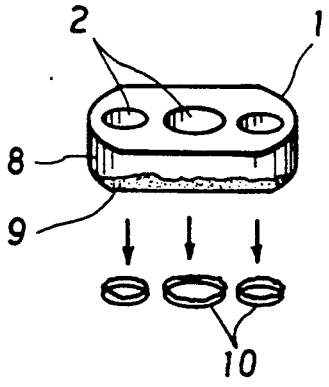
FIG. 3 is a perspective view which shows the cut surface of a precision part and a slug.

At the step of shaving the holes 2 by using the second pressing machine, as shown in FIG. 3, formation of ring-shaped slugs 10 and dropping off of the slugs 10 from the die 4 were observed.

As a result of observation made by the inventors over a long time, at the stage of about 1500 to 5000 times of blanking, the cutting ability of the punch 5 was deteriorated, and the cutting edge was worn out, with the die 4 serving as a mold being damaged and broken off. As shown in FIG. 3, a smooth shear plane 8 was formed in the upper portion of the side of the beam guide part 1 and upper portion of the inside surface of the through holes 2, and a fracture surface was formed in the lower portion of the side due to the occurrence of cracks, which was caused by blanking. Small burrs frequently occurred in the fracture surface, and the ring-shaped slug shown in FIG. 3 was formed after several pressing operations had been further performed and the slugs 10 remained on the punch 5 and die 4 without falling off. This damage of precision part products consequently caused the deterioration in quality of the parts and a significant decrease in the yield thereof.

The inventors also found that the wear and damage of the punch 5 or the die 4 were caused by the adhesion of the slug 10 to the punch 5 or the die 4, and first confirmed that the adhesion of the slug 10 was based on that the slug 10 had become a ferromagnetic substance. That is, it was confirmed that the magnetized slugs 10 should be adhered to the punch 5 or the die 4 which had been magnetized by a leakage magnetic field leaked from motors for driving the pressing system 3. It was also confirmed that although 18-8 stainless steel essentially had no magnetism, but it was magnetized by strong working such as blanking. As a result of observation of the structure of the material 6 to be worked for before and after blanking, it was first found that part of the austenitic structure was transformed to the martensitic structure, and the formation of the martensitic structure caused magnetization.

The martensitic transformation was easily observed in not only the blanking process but also processes with high working ratios such as bending, drawing process and the like. The inventors also confirmed that, although the rate of the martensite formation in non-magnetic stainless steel depended upon the working ratio, it varied within the range of 30 to 90% in any cases.

The inventors found that the yield of products can be significantly increased by preventing the martensitic transformation in the material used as much as possible. The inventors also found that non-magnetic stainless steel exhibiting both satisfactory workability and quality, as compared with conventional materials, could be produced by adjusting the composition within an appropriate range so as to set the ratio of the martensitic transformation to a value within an appropriate range. The present invention was achieved on the basis of these findings.

The non-magnetic stainless steel in accordance with the present invention is characterized in that the iron-based alloy structure containing 9 to 22% by weight of nickel, 12 to 26% by weight of chromium, the balance of iron and inevitable impurities has a ratio of the martensitic area of 20% or less.

It is preferable to mix 50 to 5000 ppm of nitrogen, 0.1 wt % or less of carbon, 1 wt % or less of silicon and 10 wt % of manganese with the above iron-based alloy.

When the non-magnetic stainless steel is used for electron beam guide parts of a television electron gun, it is preferable that the content of Cu contained as inevitable impurities in the iron-based alloy is set to 0.15 wt % or less.

The television set beam guide part in accordance with the present invention can be obtained by blanking an iron-based alloy plate having the above composition. The iron-based alloy plate having the above composition has a ratio of the martensitic area of about 0 to 15%. Even if the iron-based alloy plate is subjected to strong working such as blanking or the like at room temperature, since the ratio of the martensitic area after working is suppressed to 20% or less, the parts produced are hardly magnetized, and the blanking operation can be stably continued. Thus, the non-magnetic beam guide parts can be effectively produced.

A description will now be given to the composition of the non-magnetic stainless steel of the present invention and the reason for providing a limit of the ratio of the martensitic area.

Nickel (Ni) contributes to the stabilization of the austenitic structure, which is soft and forms the more stable austenitic structure at room temperature together with chromium (Cr) or the other elements described below which accelerate the austenitic structure. If the nickel content is as low as less than 9%, the intended good blanking quality cannot be obtained, while if the nickel content exceeds 22%, the strength is decreased, and the heights of the burrs produced after shearing are extremely increased or the smoothness of the material is deteriorated. The nickel content is therefore set to a value within the range of 9 to 22% by weight, preferably 10 to 20% by weight, more preferably 11 to 16% by weight.

Chromium (Cr) is a basic element of stainless steel. If the chromium content is as low as less than 12%, the characteristics of stainless steel cannot be obtained, while if the content exceeds 26%, the workability is deteriorated, and the ratio of martensitic structure after shearing is increased due to an increase in the ratio of the ferritic structure, resulting in an increase in magnetism. The chromium content is therefore set to a value within the range of 12 to 26% by weight, preferably 15 to 20% by weight, more preferably 16 to 19% by weight.

Carbon (C) is an element which contributes to an increase in strength. If the carbon content exceeds to 0.1%, the deformation resistance during the shearing work is increased, and the life of the mold is thus decreased. The carbon content is therefore set to a value of 0.1% by weight or less, preferably 0.08% by weight, more preferably 0.03% by weight.

Silicon (Si) is an element which contributes to deoxidation. If the silicon content exceeds 1%, the workability is deteriorated. The silicon content is set to a value of not more than 1% by weight, preferably not more than 0.8% by weight, more preferably not more than 0.5% by weight.

Manganese (Mn) is an element which contributes to the stabilization of the austenitic structure, deoxidation and desulfurization. If the manganese content exceeds 10% by weight, the corrosion resistance is deteriorated. The manganese content is set to a value of not more than 10% by weight, preferably not more than 2% by weight, more preferably not more than 1% by weight.

The non-magnetic stainless steel of the present invention may contain small amounts of elements such as phosphorus (P), sulfur (S) and the like other than the above elements for the purpose of improving the mechanical properties, corrosion resistance or machinability, without producing any problem.

The stainless steel used contains 0 to about 0.4% of copper (Cu) which is inevitably mixed therein in the production process. However, copper easily generates copper ion and the ion has a serious influence on a fluorescent material provided on the fluorescent screen of the cathode ray tube, and copper creates the danger of damaging the cathode ray tube. It is therefore necessary that the copper content of the part material used for television electron guns is suppressed to 0.15% or less.

The stainless steel may contain other impurities such as antimony (Sb), arsenic (As), tin (Sn), lead (Pb), zinc (Zn), gallium (Ga), bismuth (Bi), selenium (Se) and tellurium (Te) for the purpose of improving the mechanical properties. The content of aforementioned impurities is set to a value of not more than 0.5% by weight, more preferably not more than 0.1% by weight so as not to deteriorate hot workability in the production process.

Elements such as cobalt (Co), vanadium (V), titanium (Ti), aluminium (Al), zirconium (Zr), niobium (Nb) and hafnium (Hf) may be added at amount of not more than 1% by weight, preferably not more than 0.5% by weight, more preferably not more than 0.1% by weight, so as not to deteriorate the workability.

Elements such as wolfram (W) and molybdenum (Mo) may be added at amount of not more than 1.0% by weight, preferably not more than 0.5% by weight, so as to stabilize the ferritic structure.

As hydrogen (H) creates hydrogen embrittlement, hydrogen content is suppressed to 0.01% or less, preferably 0.005% by weight. Oxygen (O), magnesium (Mg) and calcium (Ca) will deteriorate workability of blanking due to the formation of a non-metallic inclusion, so the content of these elements is suppressed to 0.01% or less, preferably 0.005% or less.

In addition, an attempt can be made to stabilize the austenitic structure and increase the strength by adding nitrogen(N)-containing chromium, chromium nitride or the like so as to regulate the N content in the alloy to 50 to 5000 ppm. In particular, the occurrence of sags and burrs in a part having a thin blanked portion can be reduced. In order to increase the blanking precision, the N content is preferably within the range of 100 to 2000 ppm, more preferably 150 to 1000 ppm.

In the present invention, the ratio of the martensitic area is calculated by determininq the ratio of the martensitic area to the total area of each of at least ten test sectional areas which are selected in the vicinity of the working surface and calculating the average of the ratios.

The ratio of the martensitic area significantly affects the magnetism of the material. Namely, if the martensitic area ratio exceeds 20%, the iron-based alloy material is easily magnetized after working and creates the above problems. For example, the slug produced during shearing thus easily adheres to the mold and/or the raw material which are to be magnetized, causes a damage of the mold or products and causes a decrease in the yield of products. The martensitic area ratio is therefore set to a value of 20% or less.

The martensitic area ratio of the non-magnetic stainless steel, which contains Ni and Cr within the above composition ranges and which is prepared in accordance with an ordinary production process, is 0 to about 10%. When the stainless steel plate material is subjected to strong working such as blanking and shearing at room temperature, the ratio of the martensitic area can be suppressed to 20% or less even after the working.

The ratio of the martensitic area can be determined by, for example, photographing the structure by a metal microscope with a magnification of about 400, measuring the total area and the martensitic area and calculating the ratio therebetween.

DESCRIPTION OF PREFERRED EMBODIMENTS

The characteristics of the non-magnetic stainless steel having excellent workability are described in detail below with reference to the examples described below.

A metal raw material, which was prepared by mixing the components shown in each of Examples 1 to 10 in the left column of Table 1, was melted in a highfrequency induction vacuum melting furnace and then cast to form a cast ingot which was then heated at 1150° to 1250° C. and subjected to hot forging. The ingot was further heated at 1150° to 1250° C. and then subjected to hot rolling. The products ware then subjected to solution annealing and cold rolling with the final working ratio to obtain a plate having a thickness of 2 mm.

The thus-formed plate was placed in the pressing system shown in FIG. 2 and then subjected to continuous blanking at room temperature to produce the electron gun beam guide part shown in FIG. 1. During the production, the martensitic area ratio in the shearing surface was measured, and the number of times of blanking, which was continuously performed until a slug had serious influences on the pressing system or the products by the shearing work or until no good blanked part could be obtained owing to the progress of abrasion of the mold, was measured. The results obtained are shown in the right column of Table 1.

Conventional plates materials of Comparative Examples 1 to 6 having the compositions shown in the left column of Table 1 were also subjected to blanking work. The martensitic area ratio in the shearing surface and the number of times of continuous blanking were measured for each of the conventional plate materials. The results obtained are shown in the lower column of Table 1.

TABLE 1

| Sample No. | | Composition (wt %) | | | | | | | | | | | | Martensitic Area Ratio (%) | Number of Times of Continuous Blanking (times) |
|---|---|---|---|---|---|---|---|---|---|---|---|---|---|---|---|
| | | Ni | Cr | C | Si | Mn | N | P | S | Cu | Mo | Ca | Fe | | |
| Example | 1 | 17.2 | 12.9 | 0.01 | 0.5 | 1.0 | 0.007 | 0.02 | 0.002 | 0.10 | 0.12 | — | balance | 10 | 15,000 |
| | 2 | 10.2 | 18.6 | 0.02 | 0.6 | 1.2 | 0.012 | 0.03 | 0.002 | 0.07 | 0.10 | — | " | 15 | 17,000 |
| | 3 | 11.3 | 18.5 | 0.08 | 0.8 | 0.5 | 0.006 | 0.02 | 0.001 | 0.02 | 0.14 | — | " | 18 | 16,000 |
| | 4 | 12.1 | 19.0 | 0.06 | 0.7 | 0.8 | 0.02 | 0.03 | 0.002 | 0.01 | 0.09 | — | " | 10 | 18,000 |
| | 5 | 12.5 | 18.8 | 0.01 | 0.8 | 0.5 | 0.06 | 0.03 | 0.001 | 0.06 | 0.11 | — | " | 5 | 20,000 |

TABLE 1-continued

| Sample No. | | Composition (wt %) | | | | | | | | | | | | Martensitic Area Ratio (%) | Number of Times of Continuous Blanking (times) |
|---|---|---|---|---|---|---|---|---|---|---|---|---|---|---|---|
| | | Ni | Cr | C | Si | Mn | N | P | S | Cu | Mo | Ca | Fe | | |
| | 6 | 15.0 | 19.0 | 0.02 | 0.6 | 1.0 | 0.04 | 0.02 | 0.003 | 0.05 | 0.08 | — | " | 1 | 25,000 |
| | 7 | 14.3 | 15.5 | 0.03 | 0.5 | 0.5 | 0.13 | 0.03 | 0.002 | 0.11 | 0.13 | — | " | 1 | 22,000 |
| | 8 | 20.0 | 23.5 | 0.06 | 0.8 | 1.0 | 0.05 | 0.02 | 0.003 | 0.09 | 0.10 | — | " | 0 | 18,000 |
| | 9 | 10.5 | 25.0 | 0.03 | 0.7 | 8.5 | 0.23 | 0.03 | 0.001 | 0.12 | 0.12 | — | " | 15 | 10,000 |
| | 10 | 12.0 | 18.1 | 0.02 | 0.5 | 1.1 | 0.07 | 0.02 | 0.002 | 0.08 | 0.10 | 0.002 | " | 0 | 2,200 |
| Comparative Example | 1 | 8.0 | 18.5 | 0.06 | 0.8 | 0.8 | 0.02 | 0.02 | 0.007 | 0.16 | 0.19 | — | " | 80 | 5,100 |
| | 2 | 4.5 | 19.0 | 0.12 | 0.7 | 1.5 | 0.002 | 0.03 | 0.004 | 0.12 | 0.21 | — | " | 96 | 1,500 |
| | 3 | 4.0 | 16.5 | 0.04 | 0.8 | 0.6 | 0.53 | 0.04 | 0.005 | 0.10 | 0.18 | — | " | 90 | 2,000 |
| | 4 | 8.8 | 19.0 | 0.02 | 0.8 | 1.0 | 0.04 | 0.03 | 0.003 | 0.07 | 0.19 | — | " | 35 | 6,500 |
| | 5 | 7.9 | 17.1 | 0.08 | 0.5 | 1.5 | 0.04 | 0.02 | 0.006 | 0.18 | 0.11 | 0.02 | " | 40 | 1,600 |
| | 6 | 7.7 | 27.1 | 0.05 | 0.6 | 1.4 | 0.02 | 0.02 | 0.005 | 0.13 | 0.14 | — | " | 83 | 3,400 |

As is evident from Table 1, the non-magnetic stainless steel having excellent workability of the present invention exhibits a low martensitic area ratio and a number of times of continuous blanking which is increased about 2 to 10 times, as compared with the conventional non-magnetic materials shown in Comparative Examples 1 to 6. It is therefore possible to significantly decrease the number of times of re-grinding of the mold and significantly increase the production efficiency of precision parts.

Further, since the toughness is improved by the Ni contained in the steel, and the deformation resistance during working is low because of the low carbon content, no fracture surface is formed by cracks, and a precision part having a smooth shearing surface and few burrs can be obtained at all times. There is thus no need for post-finishing of the fracture surface, and precision parts having high quality and high dimensional precision can be stably produced.

In this embodiment, the occurrence of the adhesion of slugs, which is caused by ferromagnetization of the slugs, were hardly observed during working within the range of the numbers of times of blanking shown in Table 1. There is thus no need for the work of checking slugs, which is required for conventional steel materials, and the operation of the pressing system can be easily controlled.

The grain size of each of the part materials prepared in Examples 1 to 10 was within the range of grain size numbers 7 to 9. There is a tendency that, an increase in grain size number causes a decrease in grain size, hardening of the crystal, and the extension of the fracture surface produced during blanking. In order to obtain a precision part having a smooth shearing surface in this embodiment, it is therefore preferable to prepare a material so that the grain size number is within the range of 8.0 to 8.5.

This embodiment concerns the examples in which a precision part was formed by singly using the alloy material having each of the compositions shown in Table 1. However, it was confirmed that, when the non-magnetic stainless steel of the present invention was clad on one side or both sides of a specification plate material such as conventional 18-8 stainless steel, SUS304 or the like to form a composite material which was then subjected to blanking, the part produced exhibits the same excellent blanking quality. In this case, it was also confirmed that ratio of the thickness of the conventional stainless steel to the total thickness of the composite material is preferably 2 to 20%, more preferably 5 to 15%.

As described above, the non-magnetic stainless steel having excellent workability of the present invention shows a low deformation resistance during working and has no serious influence caused by slugs produced during blanking, as compared with conventional non-magnetic materials. Further, since the non-magnetic stainless steel of the present invention has a stable structure and is not magnetized, slugs do no adhere to the mold and the plate material. The non-magnetic stainless steel therefore permits a significant increase in the life of the mold used, the stable production of precision parts of high quality and a significant improvement in the efficiency of production of precision parts by strong working such as blanking or the like.

What is claimed is:

1. A precision part made of non-magnetic stainless steel having excellent workability essentially consisting of an iron-based alloy containing 9 to 22% by weight of nickel, 12 to 26% by weight of chromium, the balance of iron and inevitable impurities, wherein the martensitic area ratio of said iron-based alloy structure is 20% or less.

2. A precision part according to claim 1, wherein said iron-based alloy further contains 50 to 5000 ppm of nitrogen.

3. A precision part according to claim 1, wherein said iron-based alloy further contains 0.1 wt % or less of carbon and 1 wt % or less of silicon.

4. A precision part according to claim 1, wherein said iron-based alloy further contains 10 wt % or less of manganese.

5. A precision part according to claim 1, wherein the content of copper contained as said impurities is set to 0.1 5 wt % or less.

6. A precision part according to any of the claims 1 to 5, wherein said alloy contains 10 to 20% by weight of nickel and 15–20% by weight of chromium.

7. A precision part according to any of the claims 1 to 5, wherein said alloy contains 11 to 16% by weight of nickel and 16 to 19% by weight of chromium.

8. A precision part according to claim 1, wherein the precision part is a beam guide part used for television cathode ray tubes.

9. A precision part according to claim 1, wherein the precision part is a gear.

* * * * *